US006404399B1

(12) United States Patent
Morita

(10) Patent No.: US 6,404,399 B1
(45) Date of Patent: Jun. 11, 2002

(54) RADAR ANTENNA

(75) Inventor: Shigeki Morita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/613,738

(22) Filed: Jul. 11, 2000

(30) Foreign Application Priority Data

Feb. 4, 2000 (JP) ..... 2000-027905

(51) Int. Cl.[7] ..... H01Q 3/12
(52) U.S. Cl. ..... 343/761; 343/757
(58) Field of Search ..... 343/761, 757, 343/758, 781 R, 781 P, 781 CA, 909; H01Q 3/12

(56) References Cited

U.S. PATENT DOCUMENTS 3,708,795 A * 1/1973 Lyons ..... 343/708
3,793,637 A * 2/1974 Meek ..... 343/761
4,253,190 A * 2/1981 Csonka ..... 455/12
4,563,064 A * 1/1986 Garas ..... 350/620
4,740,791 A * 4/1988 Darbowitch et al. ..... 342/368
5,844,527 A * 12/1998 Takashima et al. ..... 343/781 P
6,150,991 A * 11/2000 Hulderman ..... 343/781 CA

FOREIGN PATENT DOCUMENTS

JP 3-277002 12/1991

OTHER PUBLICATIONS

Introduction To Radar Systems, Second Edition, by M. Skolnik pp. 242–243.

* cited by examiner

*Primary Examiner*—Hoanganh Le
*Assistant Examiner*—Trinh Do Dinh
(74) *Attorney, Agent, or Firm*—Sughrue Mion, PLLC

(57) ABSTRACT

A radar antenna with a parabolic reflector having a combined polarization twist reflecting unit and a plane reflector that reflects and transmits radio waves according to their polarized direction and with the plane reflector disposed outside. The plane reflector is integral with the case of the antenna and is disposed at a position that is approximately half of the distance from the parabolic reflector to the focal point of the parabolic reflector. Additionally, a primary radiator is disposed at a center position of the parabolic reflector and at a distance for the plane reflector that is approximately a distance from the plane reflector to the focal point of the plane reflector.

3 Claims, 5 Drawing Sheets

RADAR ANTENNA

BACKGROUND OF THE INVENTION

1. Field of the Invention

The present invention relates to a radar antenna having a parabolic reflector and a plane reflector.

2. Description of the Related Art

FIG. 9 is a structural view showing an example of a conventional radar antenna. In the figure, a parabolic reflector 2 for reflecting a radio wave is disposed in a case 1. The parabolic reflector 2 is driven by an actuator 3 to change the direction of the radio wave. A primary radiator 4 for radiating the radio wave toward the parabolic reflector 2 is supported by the parabolic reflector 2. The primary radiator 4 is disposed at a distance that equals to the distance from the parabolic reflector 2 to the focal point of the parabolic reflector 2.

FIG. 10 is a structural view showing another conventional radar antenna disclosed, for example, on page 243 of "INTRODUCTION TO RADAR SYSTEMS, second edition" by Merril I. Skolnik. In the figure, a parabolic reflector 6 is integrally formed as a part of a case 5. A plane reflector 7 is disposed in the case 5 so as to face the parabolic reflector 6. The plane reflector 7 is driven by an actuator 8 to change the direction of the radio wave. A primary radiator 9 for radiating the radio wave toward the parabolic reflector 6 is provided in the middle of the plane reflector 7.

In the radar antenna illustrated in FIG. 9, however, in order to change the direction of the radio wave, it is necessary to drive the whole assembly of the parabolic reflector 2 and the primary radiator 4, and thus, the mechanism has to be large.

On the other hand, since the radar antenna illustrated in FIG. 10 employs a structure in which only the plane reflector having a polarization twist reflecting unit is driven, the mechanism is simplified. However, since it is necessary to secure the focal distance of the parabolic reflector 6 between the parabolic reflector 6 and the plane reflector 7, the thickness of the antenna has to be large. Further, since the front face of the antenna is parabolized, when the antenna is actually mounted, it is necessary to additionally provide a radome (not shown) taking the design into consideration. Further, in such a case, since it is necessary to keep certain distance between the parabolic reflector 6 and the radome in order to maintain the performance, the thickness of the antenna becomes still larger, and loss due to the radome is caused.

Japanese Patent Application Laid-open No. Hei 3-277002 discloses a radar antenna having a combination of two parabolic reflectors. However, in such a case, it also requires a radome when it is mounted, and a loss due to the radome is caused.

SUMMARY OF THE INVENTION

The present invention has been made to solve the problems described in the above, and therefore has an object to provide a radar antenna that is thin and capable of preventing a large loss and simplifying the structure of a mechanism thereof.

To this end, according to one aspect of the present invention, there is provided a radar antenna comprising: a parabolic reflector including a first dielectric, a plurality of first linear conductors and a back conductor, the first dielectric having first and second paraboloids, the first linear conductors being provided in parallel with one another at intervals on the first paraboloid for reflecting a radio wave, the back conductor being provided on the second paraboloid for reflecting the radio wave which has passed between the first linear conductors and through the first dielectric; a plane reflector for passing through the radio wave reflected by the parabolic reflector, including a plate-like second dielectric and a plurality of second linear conductors for reflecting the radio wave toward the parabolic reflector, the second dielectric having an opposing surface which opposes the first paraboloid, the second linear conductors being provided in parallel with one another at intervals on the opposing surface; a primary radiator for radiating the radio wave toward the plane reflector; and a driving unit for moving the parabolic reflector to change the reflection angle of the radio wave.

According to another aspect of the present invention, there is provided a radar antenna comprising: a parabolic reflector including a first dielectric, a plurality of first linear conductors and a back conductor, the first dielectric having first and second paraboloids, the first linear conductors being provided in parallel with one another at intervals on the first paraboloid for reflecting a radio wave, the back conductor being provided on the second paraboloid for reflecting the radio wave which has passed between the first linear conductors and through the first dielectric; a plane reflector for passing through the radio wave reflected by the parabolic reflector, including a plate-like second dielectric and a plurality of second linear conductors for reflecting the radio wave toward the parabolic reflector, the second dielectric having an opposing surface which opposes the first paraboloid, the second linear conductors being provided in parallel with one another at intervals on the opposing surface; a primary radiator for radiating the radio wave toward the plane reflector; and a driving unit for moving the plane reflector to change the reflection angle of the radio wave.

DETAILED DESCRIPTION OF THE PREFERRED EMBODIMENTS

Embodiments of the present invention will be described with reference to the drawings.

Embodiment 1

Figure 1:
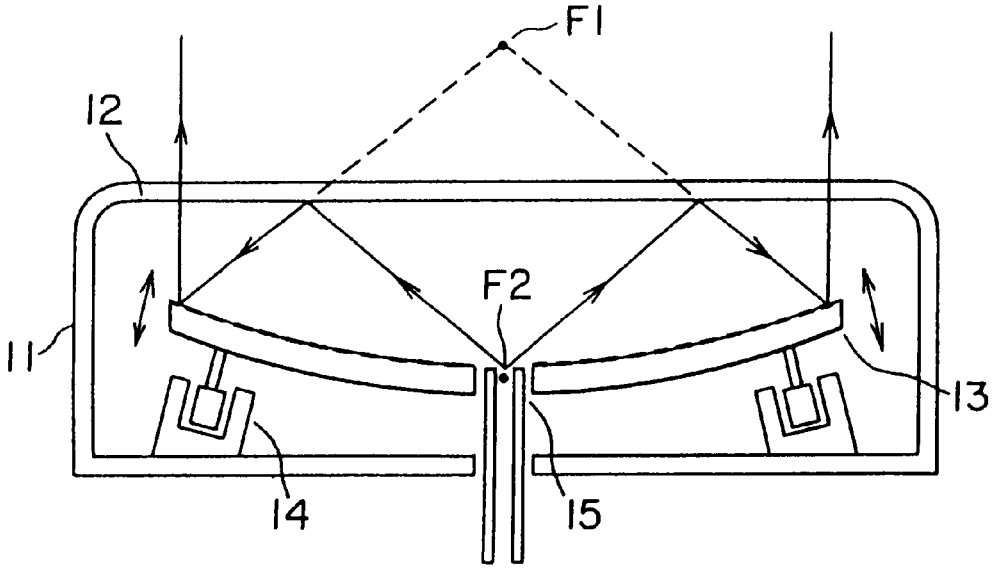
FIG. 1 is a structural view showing a radar antenna according to a first embodiment of the present invention.

FIG. 1 is a structural view showing a radar antenna according to a first embodiment of the present invention. In the figure, a plane reflector 12 is integrally formed as a part of a case 11 at the front face of the case. A parabolic reflector 13 is disposed in the case 11 so as to face the plane reflector 12. The parabolic reflector 13 is driven by an actuator 14 as driving unit to change the reflection angle of the radio wave. A primary radiator 15 for radiating the radio wave toward the plane reflector 12 is provided in the middle of the parabolic reflector 13.

The plane reflector 12 is disposed at a position that is a half of a distance, or in the vicinity thereof, from the parabolic reflector 13 to the focal point F1 of the parabolic reflector 13. The primary radiator 15 is disposed at a position that is a distance, or in the vicinity thereof, from the plane reflector 12 to the focal point F2 of the plane reflector 12.

Figure 2:
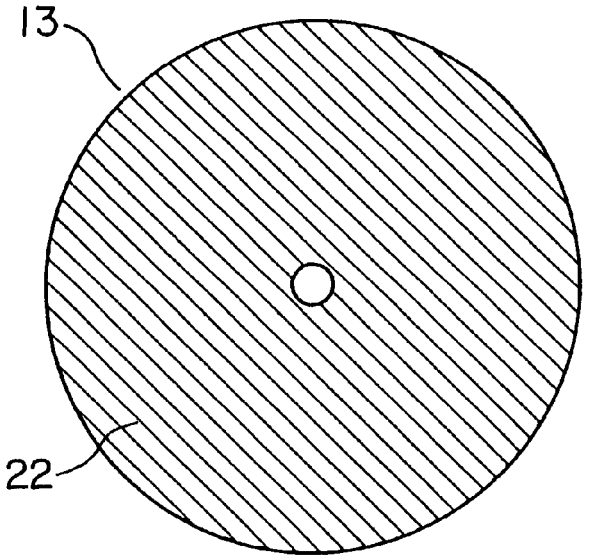
FIG. 2 is a front view showing the parabolic reflector in FIG. 1.
Figure 3:
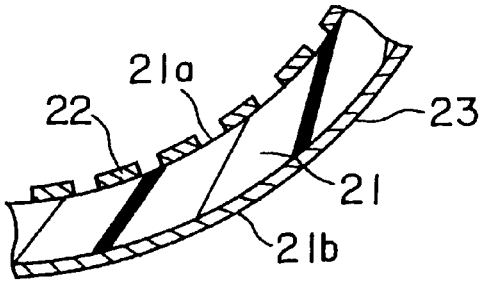
FIG. 3 is a partial sectional view of the parabolic reflector in FIG. 2.

FIG. 2 is a front view showing the parabolic reflector 13 in FIG. 1. FIG. 3 is a partial sectional view of the parabolic reflector 13 in FIG. 2. The parabolic reflector 13 is a reflector that carries out polarization twist reflection. Therefore, the parabolic reflector 13 comprises a first dielectric 21 having first and second paraboloids 21*a* and 21*b*, a plurality of first linear conductors 22 provided in parallel with one another at intervals on the first paraboloid 21*a* for reflecting the radio wave, and a back conductor 23 provided over the whole of the second paraboloid 21*b* for reflecting the radio wave which has passed between the first linear conductors 22 and through the first dielectric 21.

Figure 4:
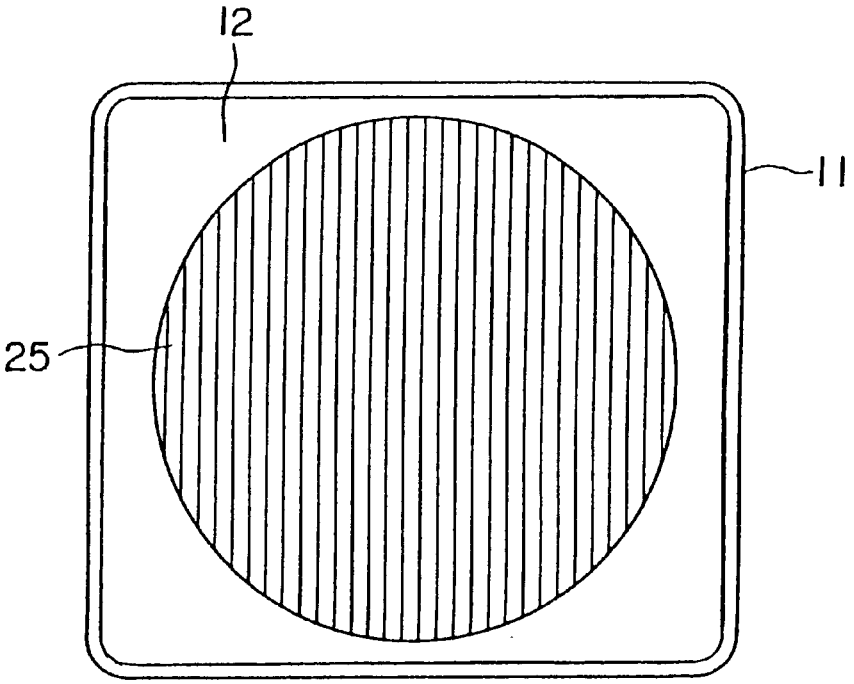
FIG. 4 is a rear view showing the plane reflector in FIG. 1.
Figure 5:
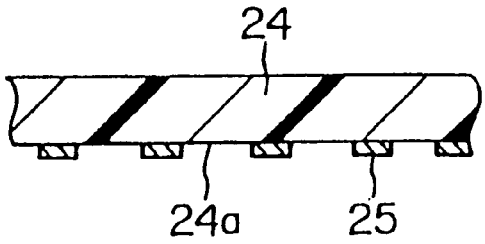
FIG. 5 is a partial sectional view of the plane reflector in FIG. 4.

FIG. 4 is a rear view showing the plane reflector 12 in FIG. 1. FIG. 5 is a partial sectional view of the plane reflector 12 in FIG. 4. The plane reflector 12 is a reflector that carries out selective reflection according to the polarization direction of the radio wave. Therefore, the plane reflector 12 comprises a plate-like second dielectric 24 having an opposing surface 24*a* which opposes the first paraboloid 21*a* and a plurality of second linear conductors 25 provided in parallel with one another at intervals on the opposing surface 24*a* for reflecting the radio wave toward the parabolic reflector 13.

The first and second dielectrics 21 and 24 are formed, for example, of plastic. The first and second linear conductors 22 and 25 are formed, for example, in a process in which plating and etching are combined. The back conductor 23 is formed, for example, by plating.

Next, operation of the antenna is described in the following. When the polarized direction of the radiated radio wave is to be horizontal, the radio wave radiated with vertical polarization from the primary radiator 15 is reflected by the second linear conductors 25, and, by the first linear conductors 22 disposed so as to form an angle of 45 degrees with respect to the second linear conductors 25, that is, by the polarization twist reflecting unit, the polarized direction is rotated by 90 degrees. The horizontally polarized radar beams provided in parallel with one another pass between the second linear conductors 25 to be radiated in the air. In order to change the beam direction, the parabolic reflector 13 having the polarization twist reflecting unit is driven by the actuator 14.

Figure 6:
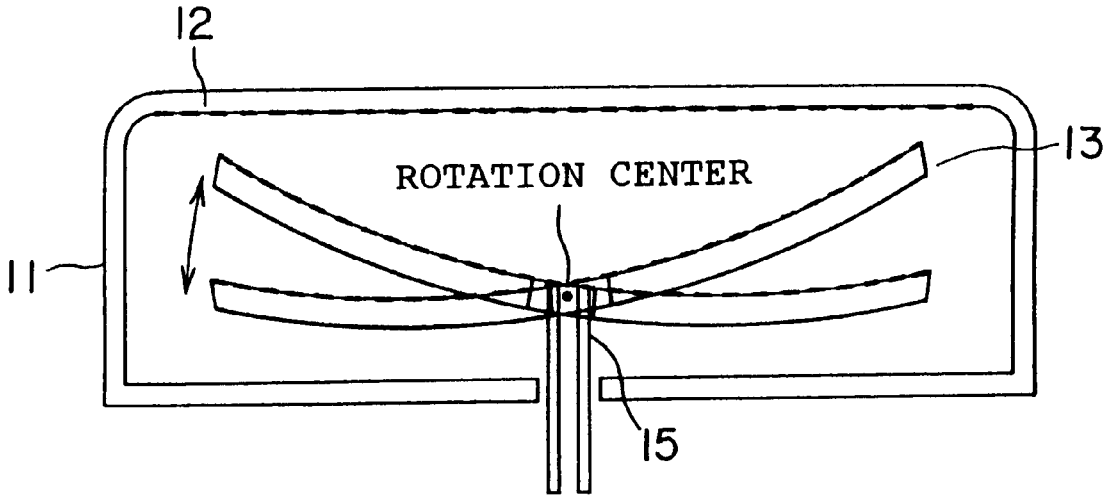
FIG. 6 is an explanatory view showing an example of a method for changing the beam direction of the radar antenna in FIG. 1.
Figure 7:
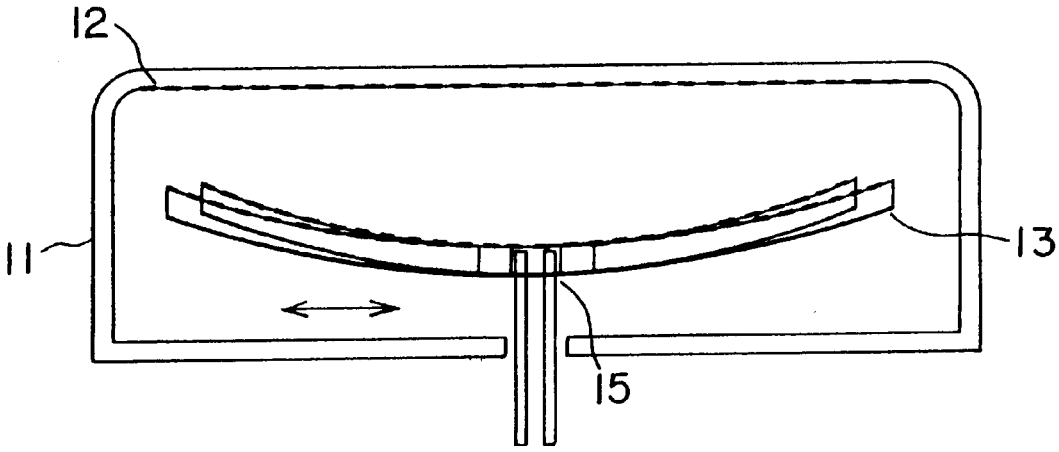
FIG. 7 is an explanatory view showing another method for changing the beam direction of the radar antenna in FIG. 1.

FIG. 6 is an explanatory view showing an example of a method for changing the beam direction of the radar antenna in FIG. 1. FIG. 7 is an explanatory view showing another method for changing the beam direction of the radar antenna in FIG. 1. Methods for changing the beam direction include a method in which the parabolic reflector 13 is rotated about a rotation center provided around the primary radiator 15 as illustrated in FIG. 6, and a method in which the parabolic reflector 13 is parallelly displaced as illustrated in FIG. 7.

In such a radar antenna, since the parabolic reflector 13 having the polarizaton twist reflecting unit and the plane reflector 12 which reflects or transmits the radio wave according to the polarized direction are combined, and also since the plane reflector 12 is disposed outside, the thickness as a whole can be made smaller. Further, since an additional radome is not required, loss due to such a radome can be prevented. Further, the primary radiator 15 remains fixed when the beam direction is changed with the result that the structure of the mechanism can be simplified.

Still further, since the plane reflector 12 is disposed at a position that is a half of the distance, or in the vicinity thereof, from the parabolic reflector 13 to the focal point F1 of the parabolic reflector 13, and the primary radiator 15 is disposed at a position that is a distance, or in the vicinity thereof, from the plane reflector 12 to the focal point F2 of the plane reflector 12, the thickness as a whole can be made small while the efficiency can be improved.

Further, since the plane reflector 12 is integrally formed with the case 11 as a part of the case 11, the thickness as a whole can be made still smaller.

Embodiment 2

Figure 8:
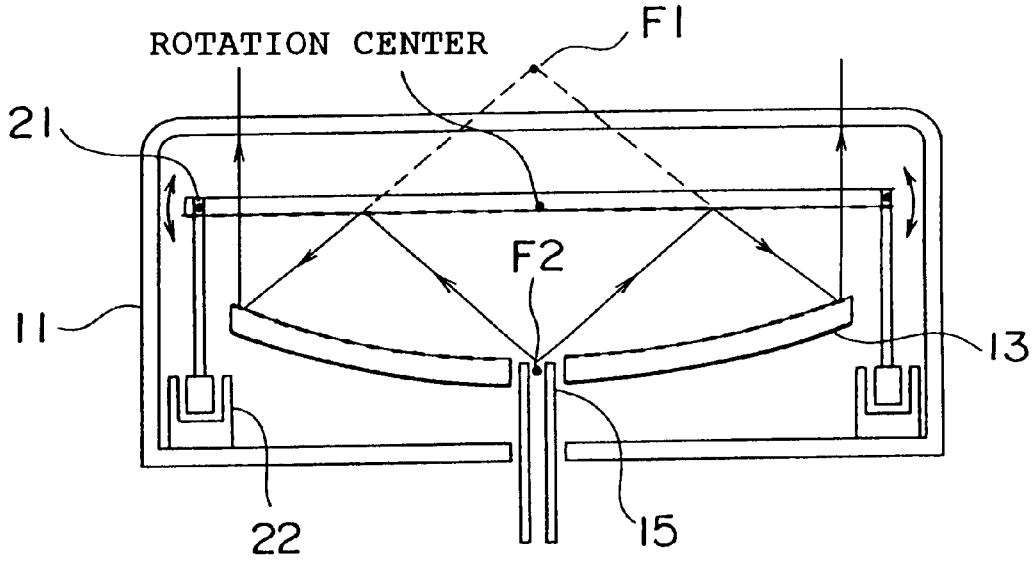
FIG. 8 is a structural view showing a radar antenna according to a second embodiment of the present invention.
Figure 9:
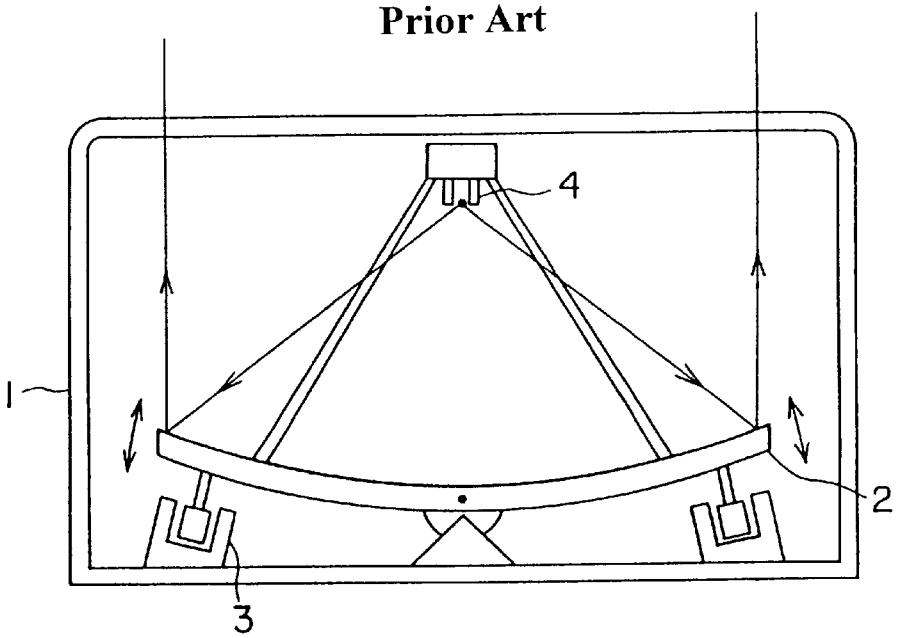
FIG. 9 Prior Art
FIG. 9 is a structural view showing an example of a conventional radar antenna.
Figure 10:
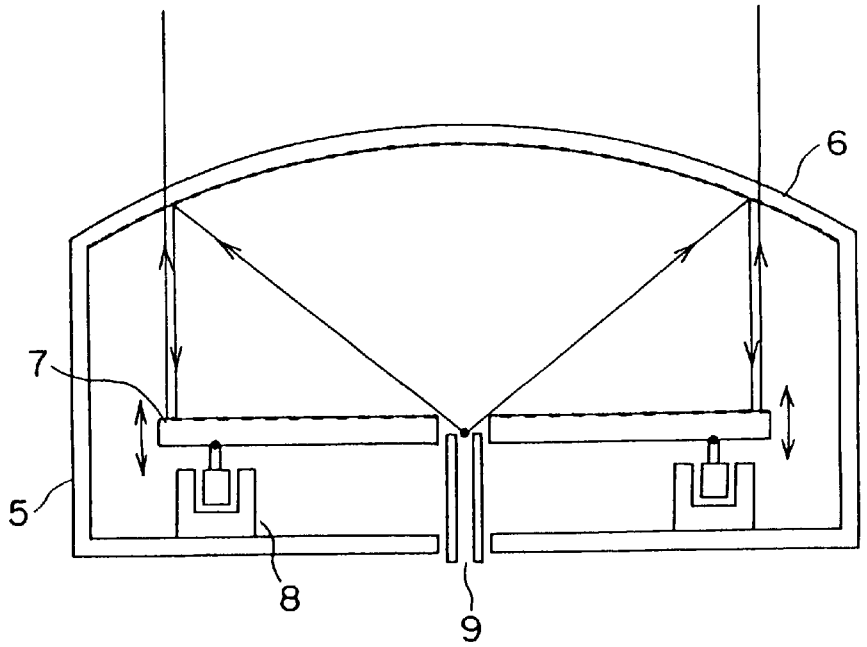
FIG. 10 Prior Art
FIG. 10 is a structural view showing another conventional radar antenna.

FIG. 8 is a structural view showing a radar antenna according to a second embodiment of the present invention. While the parabolic reflector 13 is driven in the first embodiment, the plane reflector 21 is driven in the second embodiment. More specifically, the plane reflector 21 is rotated about a rotation center by an actuator (driving unit) 22. This also can change the beam direction.

It is to be noted that, in order to secure the performance over a wider angular range, both the plane reflector and the parabolic reflector may be driven. Further, the beam direction may also be changed by arranging a plurality of primary radiators 15 and switching the primary radiators 15 to be used.

What is claimed is:

1. A radar antenna comprising:

a parabolic reflector including a first dielectric, a plurality of first linear conductors and a back conductor, said first dielectric having first and second paraboloid surfaces, said first linear conductors being provided in parallel with one another at intervals on said first paraboloid surface for reflecting a radio wave, said back conductor being provided on said second paraboloid surface for reflecting the radio wave which has passed between said first linear conductors and through said first dielectric;

a plane reflector for passing through the radio wave reflected by said parabolic reflector, including a plate-like second dielectric and a plurality of second linear conductors for reflecting the radio waves toward said parabolic reflector, said second dielectric having an opposing surface which opposes said first paraboloid surface, said second linear conductors being provided in parallel with one another at intervals on said opposing surface;

a primary radiator for radiating the radio wave toward said plane reflector; and a driving unit for mechanically moving said parabolic reflector to change the reflection angle of the radio wave while said plane reflector and said primary radiator remain in a fixed position relative to said parabolic reflector.

2. The radar antenna as claimed in claim 1, further comprising a case enclosing said parabolic reflector, wherein said plane reflector is integrally formed with said case.

3. The radar antenna as claimed in claim 1, wherein said plane reflector is disposed at a position that is approximately halfway between said parabolic reflector and the focal point of said parabolic reflector, and said primary radiator is disposed at a center position of said parabolic reflector and at a distance from the plane reflector that is approximately the distance from said plane reflector to the focal point of said plane reflector.

* * * * *